US006098325A

United States Patent [19]

Goldman

[11] Patent Number: 6,098,325

[45] **Date of Patent: *Aug. 8, 2000**

[54] DISPLAY HAVING SELECTABLE SIMULATED ILLUMINATING MEANS

[76] Inventor: David A. Goldman, 538 Croton Heights Rd., Yorktown Heights, N.Y. 10598

[ * ] Notice: This patent is subject to a terminal disclaimer.

[21] Appl. No.: 09/170,899

[22] Filed: Oct. 13, 1998

Related U.S. Application Data

[63] Continuation-in-part of application No. 08/837,367, Apr. 17, 1997, Pat. No. 5,881,482.

[51] Int. Cl.[7] ..... G09F 11/04

[52] U.S. Cl. ..... 40/495; 40/113; 434/178; 283/15.1

[58] Field of Search ..... 40/495, 113; 434/178; 281/29, 15.1, 45, 51

[56] References Cited

U.S. PATENT DOCUMENTS

| | | | |
|---|---|---|---|
| 1,177,652 | 4/1916 | Robertson | 40/495 |
| 2,917,325 | 12/1959 | Sines | 434/178 |
| 2,959,872 | 11/1960 | Rodgers | 40/495 |
| 4,642,054 | 2/1987 | Wada | 434/178 |

*Primary Examiner*—Cassandra H. Davis
*Attorney, Agent, or Firm*—John H. Crozier

[57] ABSTRACT

In a preferred embodiment, a display device, including: a front panel and/or a rear panel having defined therethrough at least two apertures; and an index panel(s) disposed behind the front panel and/or the rear panel and moveable between at least first and second positions to vary what can be viewed through the at least two apertures by an observer looking at the front panel and/or the rear panel. In one aspect of the invention, the display device is a book, with the front panel and/or the rear panel being a page(s) of the book and the index wheel(s) being disposed at the front and/or the rear of the book.

21 Claims, 12 Drawing Sheets

DISPLAY HAVING SELECTABLE SIMULATED ILLUMINATING MEANS

CROSS-REFERENCE TO RELATED APPLICATIONS

The present application is a continuation-in-part of application Ser. No. 08/837,367, filed Apr. 17, 1997, and titled DISPLAY HAVING SELECTABLE SIMULATED ILLUMINATING MEANS, now U.S. Pat. No. 5,881,482, issued Mar. 16, 1999.

BACKGROUND OF THE INVENTION

1. Field of the Invention

The present invention relates to displays generally and, more particularly, but not by way of limitation, to a novel display having selectable simulated illuminating means.

2. Background Art

There are a number types of displays in which it is desirable to vary the display, often as related to time. Examples of such displays are menus, schedules, and certain types of greeting cards. While the present invention is described primarily with reference to greeting cards, it will be understood that the invention is applicable as well to any type of display having the requirements satisfied by the invention.

A "greeting card" is typically a piece of paper or thin cardboard, usually small and rectangular, printed with a message of holiday greeting, congratulations, good wishes, sympathy, or other sentiment, often with an illustration or decorations, for mailing to a friend or relative on an appropriate occasion. The more elaborate of such cards often include portions thereof which fold out from the plane of the card and may even include audible messages emitted from embedded electronic circuitry.

Some greeting cards, such as those used for Chanukah, Christmas, Advent, or birthdays include in the graphics thereon pictures of candles or lights. Since such illuminating means are only pictorially shown, they lack the vibrance of real illuminating means. It would be desirable to have some means of providing simulated illuminating means on greeting cards which are more realistic than mere pictorial representations.

Others of such greeting cards are related in one way or another to time. For example, a Chanukah greeting card typically includes an illustration of a menorah, frequently an eight-branched candelabrum usually with a central shammash, or candle, used for lighting the eight candles disposed at the distal ends of the eight branches, one additional candle being lit every day for the eight days of the festival of Chanukah. By necessity, the pictorial representation of the menorah shows all candles lighted. In addition to having more realistic representations of candles, it would be desirable to have some means of showing the proper number of candles lit for each day of the festival.

Another time-related greeting card is a birthday card. Often, especially in the case of younger children, a birthday card may indicate an age, e.g., four years old, and show a birthday cake with four lighted candles on it. This requires that a greeting card seller maintain an inventory of cards for a range of ages. In addition to having more realistic representations of candles, it would be desirable to have means to selectively adjust the stated age and the number of candles shown as lighted on a card, in order to reduce the amount of inventory required.

Accordingly, it is a principal object of the present invention to provide a greeting card having a selectable number of simulated illuminating means.

It is a further object of the invention to provide such a greeting card that is simply and economically manufactured.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a display device, comprising: a panel having defined therethrough at least two apertures; and an index panel disposed behind said panel and moveable between at least first and second positions to vary what can be viewed through said at least two apertures by an observer looking at said panel. In one aspect of the invention, the display device comprises a book, with the front panel thereof being a page of said book and said index wheel being disposed at the front or the end of said book. In another aspect of the invention the display device comprises a greating card.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
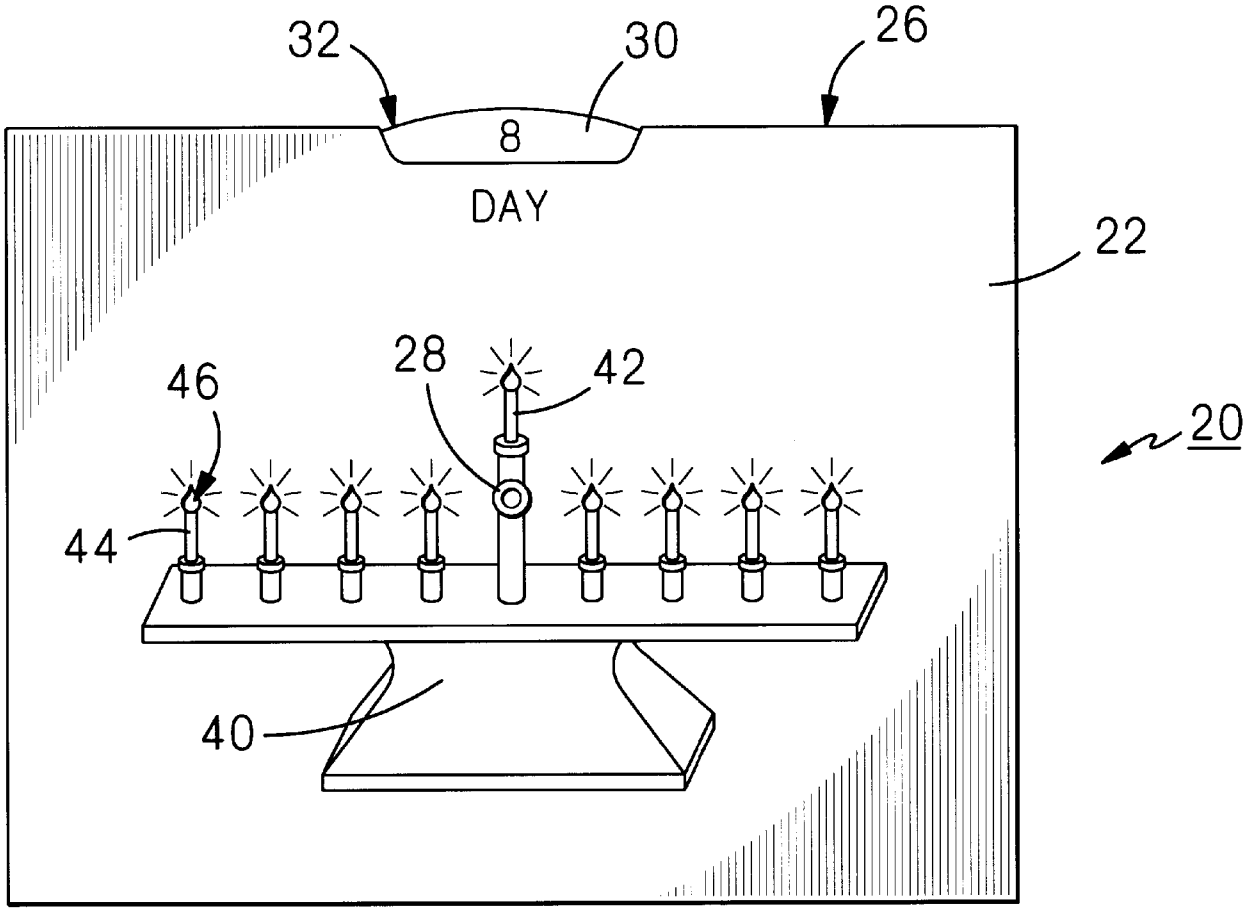
FIG. 1 is a front elevational view of a Chanukah card constructed according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
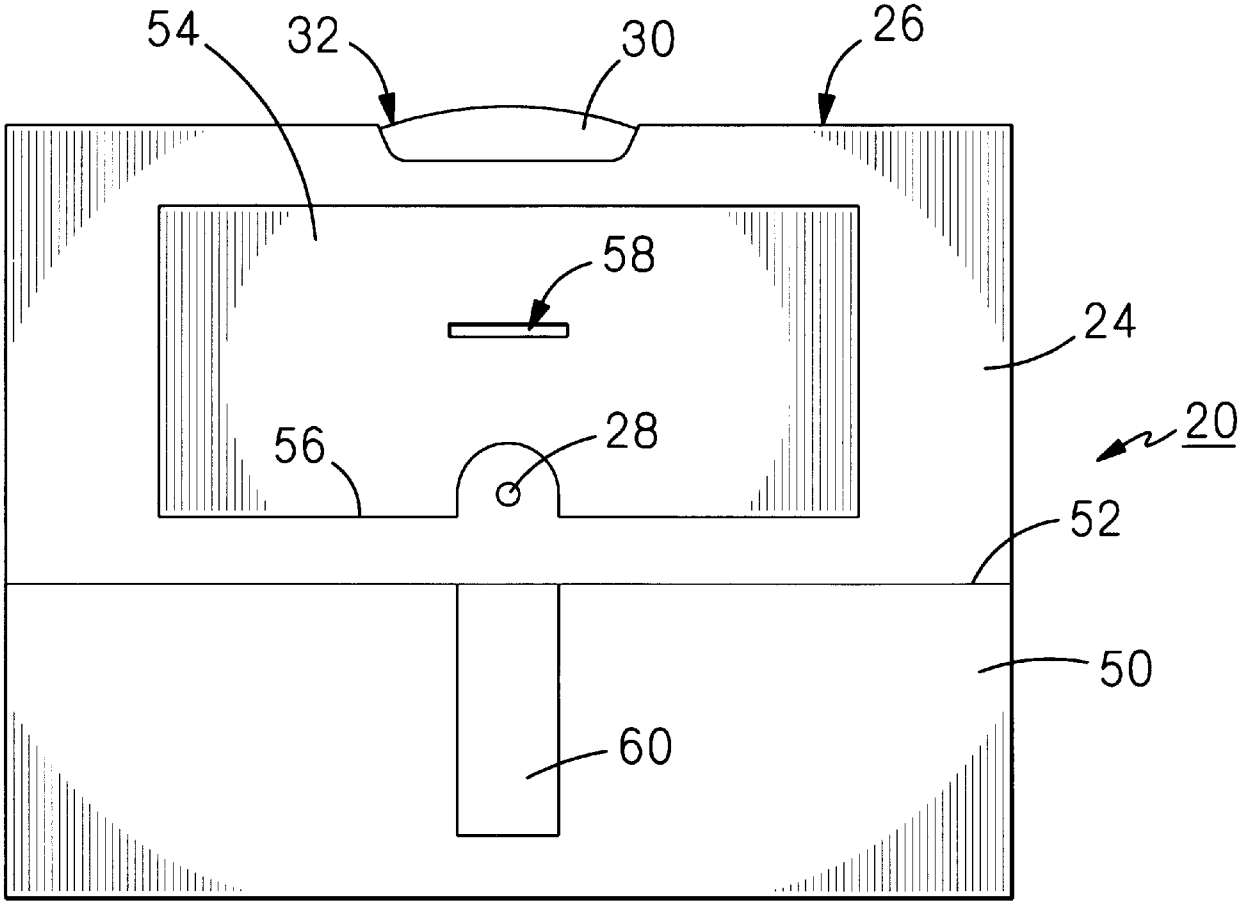
FIG. 2 is a rear elevational view of the Chanukah card of FIG. 1 in a folded state.
Figure 3:
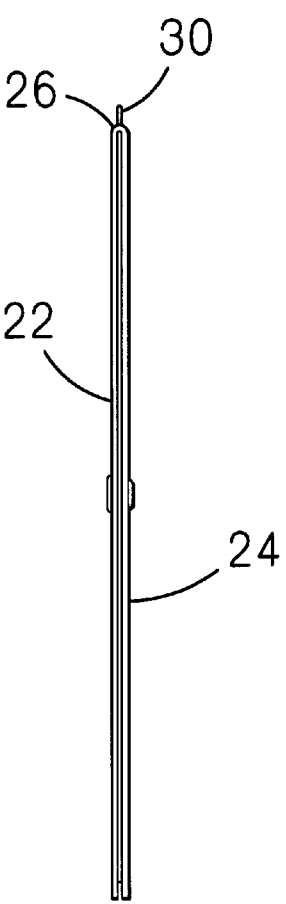
FIG. 3 is a side elevational view of the folded Chanukah card.

FIGS. 1–3 illustrate a Chanukah card, generally indicated by the reference numeral 20, and constructed according to the present invention. Card 20 has front and rear panels 22 and 24, respectively, formed by folding a single sheet of material, such as a thin cardboard material, so that a horizontal fold 26 is created at the top of the card. A portion of the rim of an index wheel 30 extends upwardly through an a slit 32 formed in fold 26. Index wheel 30 is rotatable around shaft means 28 which may be a rivet extending through front and rear panels 22 and 24.

As shown on FIG. 1, the front surface of front panel 22 includes thereon a representation of a menorah 40 having a shammash 42 and eight candles, as at 44, representing the eight days of Chanukah. The portion of the index wheel 30 visible on FIG. 1 includes the numeral "8", indicating the eighth day of Chanukah, and, accordingly, all candles are shown as being "lighted", which lighted state is simulated by light shining through flame-shaped apertures, as at 46, defined through front panel 20. It can be seen on FIG. 3 that, when card 20 is in its folded state, its thickness is about the same as a conventional greeting card and its other dimensions, as well as weight, are also typical of a conventional greeting card.

Referring to FIG. 2, rear panel 22 includes a die cut support panel 50 which is foldable upwardly along fold line 52, a die cut reflective panel 54 which is foldable downwardly along a fold line 56 and which has a generally centrally disposed slot 58 defined therethrough, and a die cut support tab 60 which is foldable upwardly along fold line 52.

Figure 4:
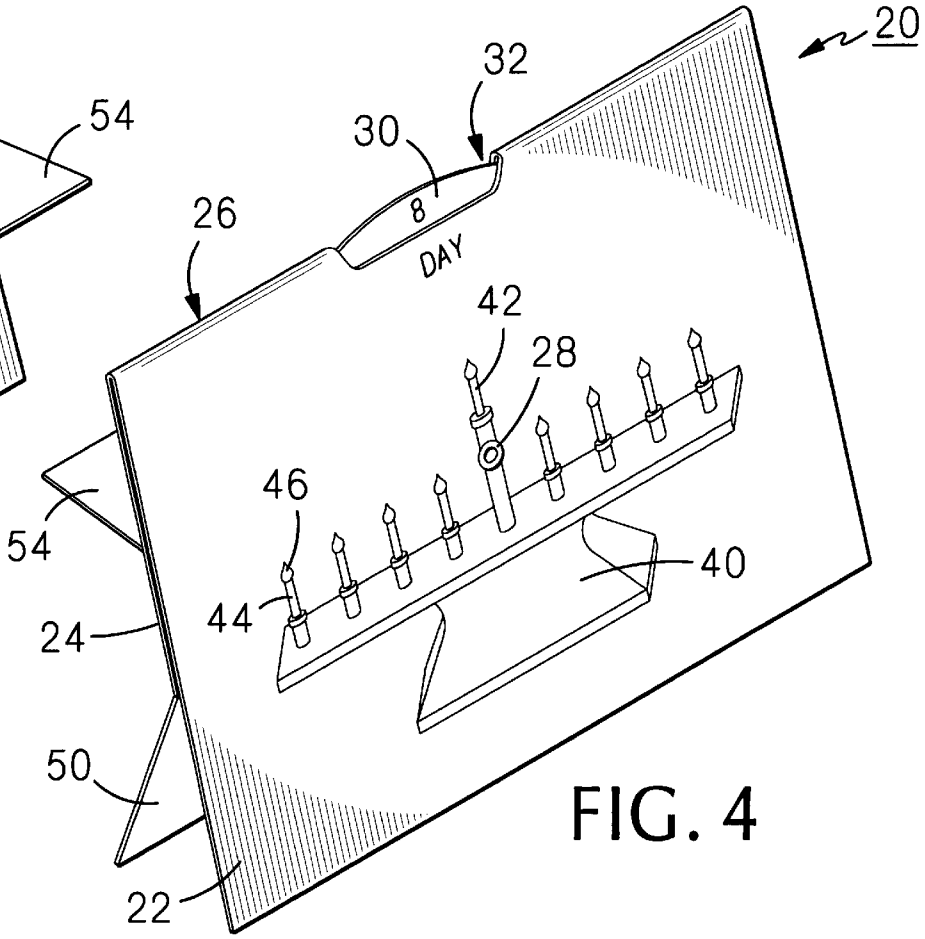
FIG. 4 is a top/front/side isometric view of the Chanukah card unfolded for display.
Figure 5:
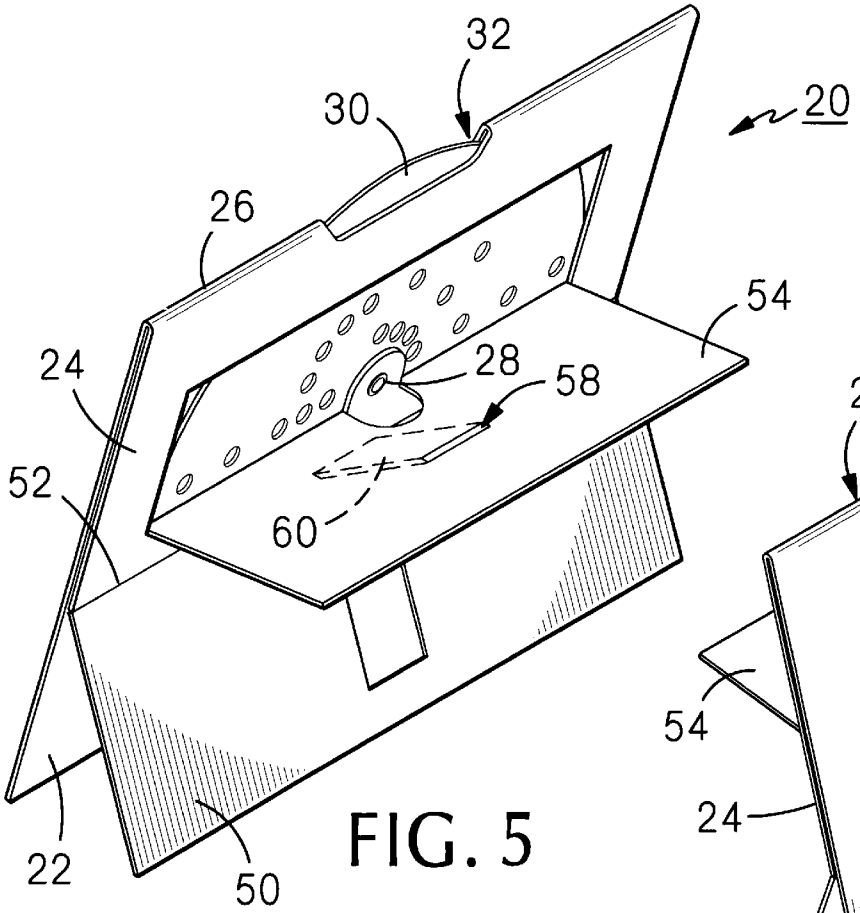
FIG. 5 is a top/rear/side isometric view of the Chanukah card unfolded for display.

FIGS. 4 and 5 illustrate card 20 unfolded and in its display state. Here, support panel has been folded outwardly such that its lower edge and the lower edge of now-slightly inclined front panel 22 can engage a horizontal support surface (not shown) to stably support card 20. Reflective panel 54 has been folded downwardly (FIG. 5) and support tab 60 folded upwardly and the distal end thereof inserted into slot 58 to maintain the reflective panel in a desired angular position with respect to rear panel 24.

Figure 6:
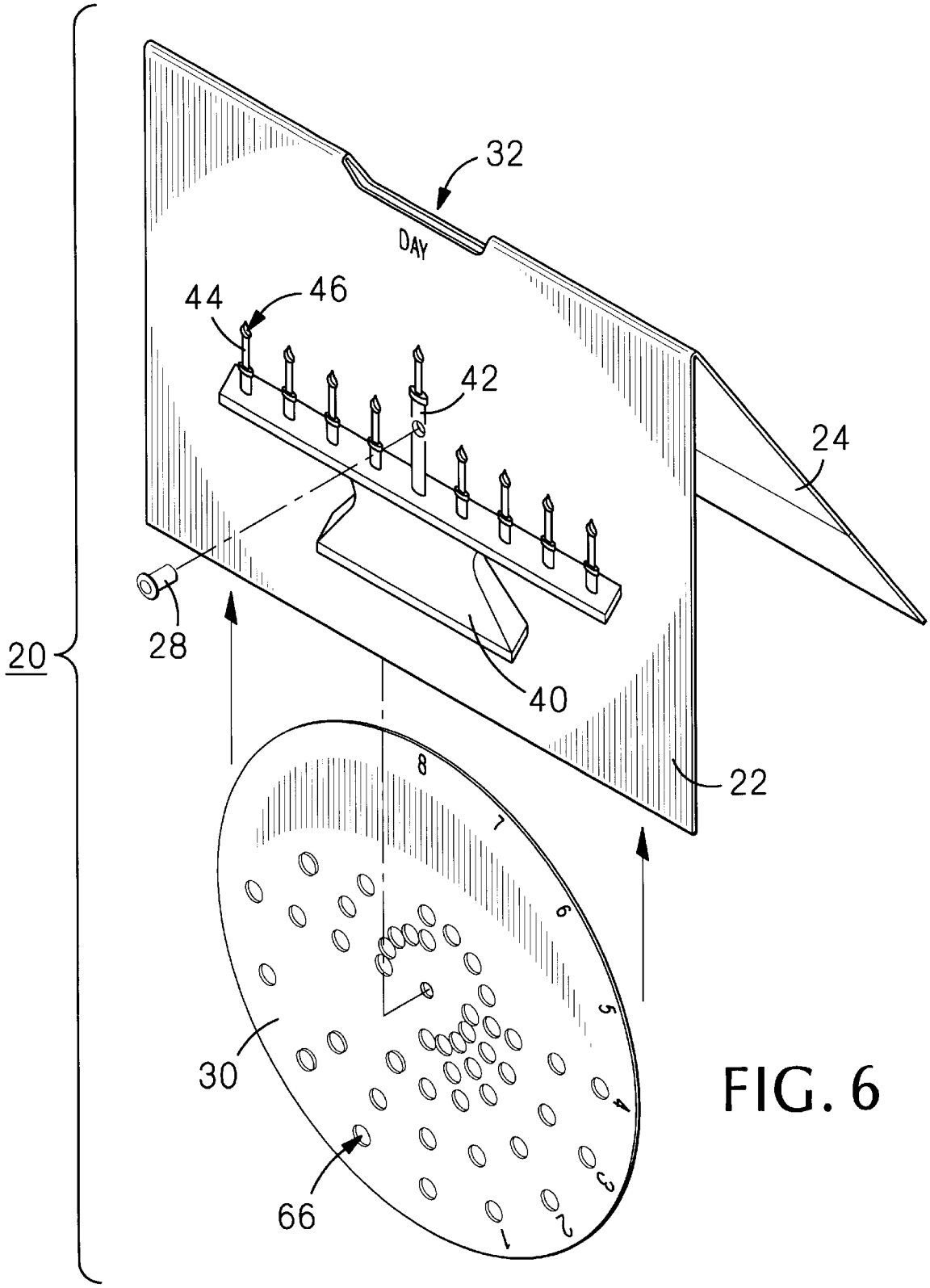
FIG. 6 is an exploded isometric view showing the construction of the Chanukah card.

FIG. 6 illustrates that card 20 is simply constructed, the elements thereof being the sheet from which front and rear panels 22 and 24, respectively, are formed, index wheel 30, and a rivet 28. As indicated above, certain elements of rear panel 24 (FIG. 2) may be die cut. Index wheel 30 may be formed of a suitable thin cardboard material. FIG. 6 clearly shows that index wheel has defined therethrough a plurality of apertures, as at 66, which may also be formed in a die cutting operation. Thus, card 20 may be simply constructed by conventional die cutting, printing, and simple assembly operations.

Figure 7:
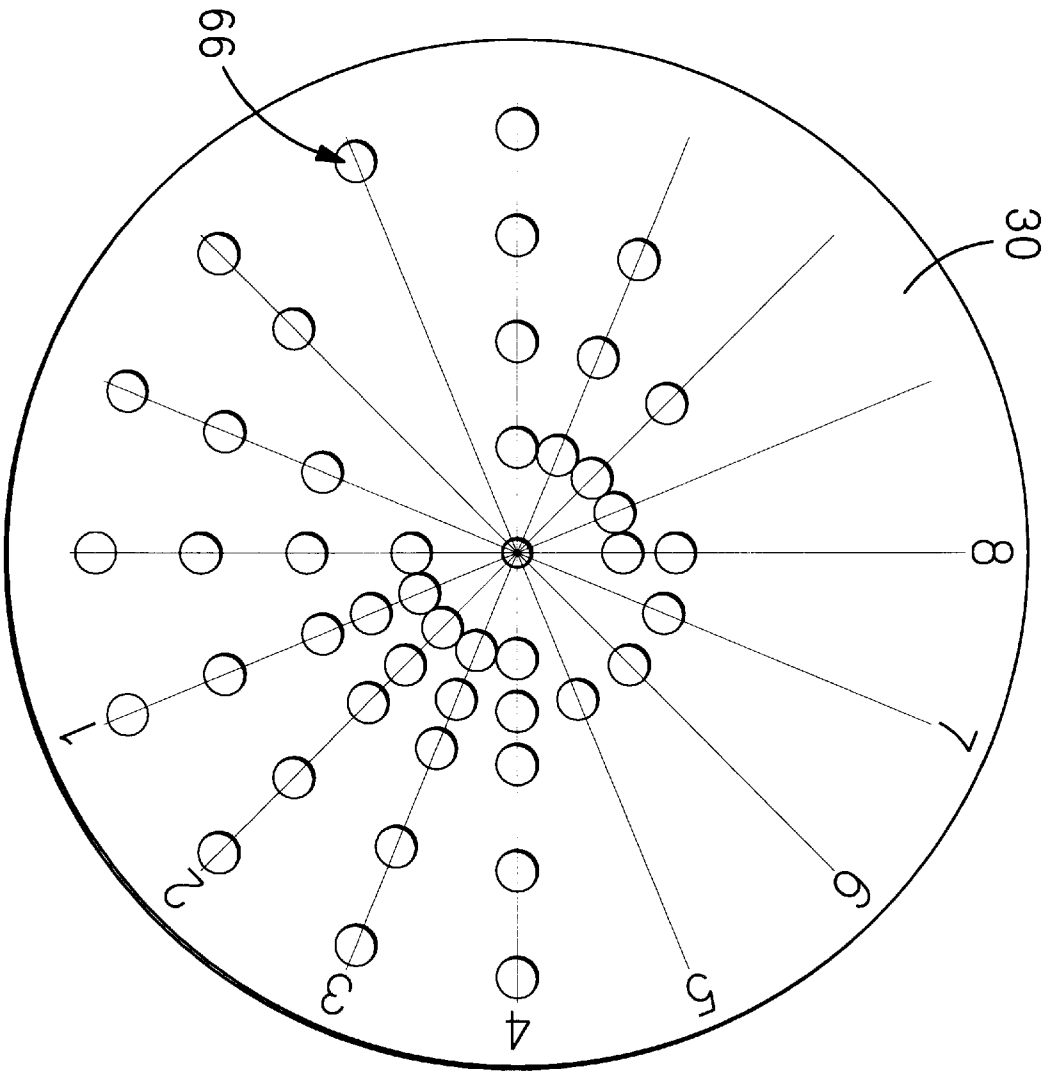
FIG. 7 is a front elevational view of the index wheel for the Chanukah card.

FIG. 7 illustrates more clearly holes, as at 66, defined through index wheel 30. Holes 66 are arranged such that the number of holes aligned with apertures 46 through front panel 22 will be equal to the numeral at the top of index wheel 30. For example, in the orientation of index wheel 30 shown on FIG. 7, the numeral "8" is at the top of the wheel and eight holes 66 will be aligned with all the eight apertures 46, as is the case on FIG. 1. Similarly, when index wheel is rotated so that the numeral "5" is at the top of the wheel, five of holes 66 will be aligned with five of apertures 46. Rotation in eight 22.5-degree steps provides the necessary eight changes of position of index wheel 30. Shammash 42 (FIG. 1) has its own aperture with which one of holes 66 is aligned in any of the eight rotational positions of index wheel 30.

Figure 8:
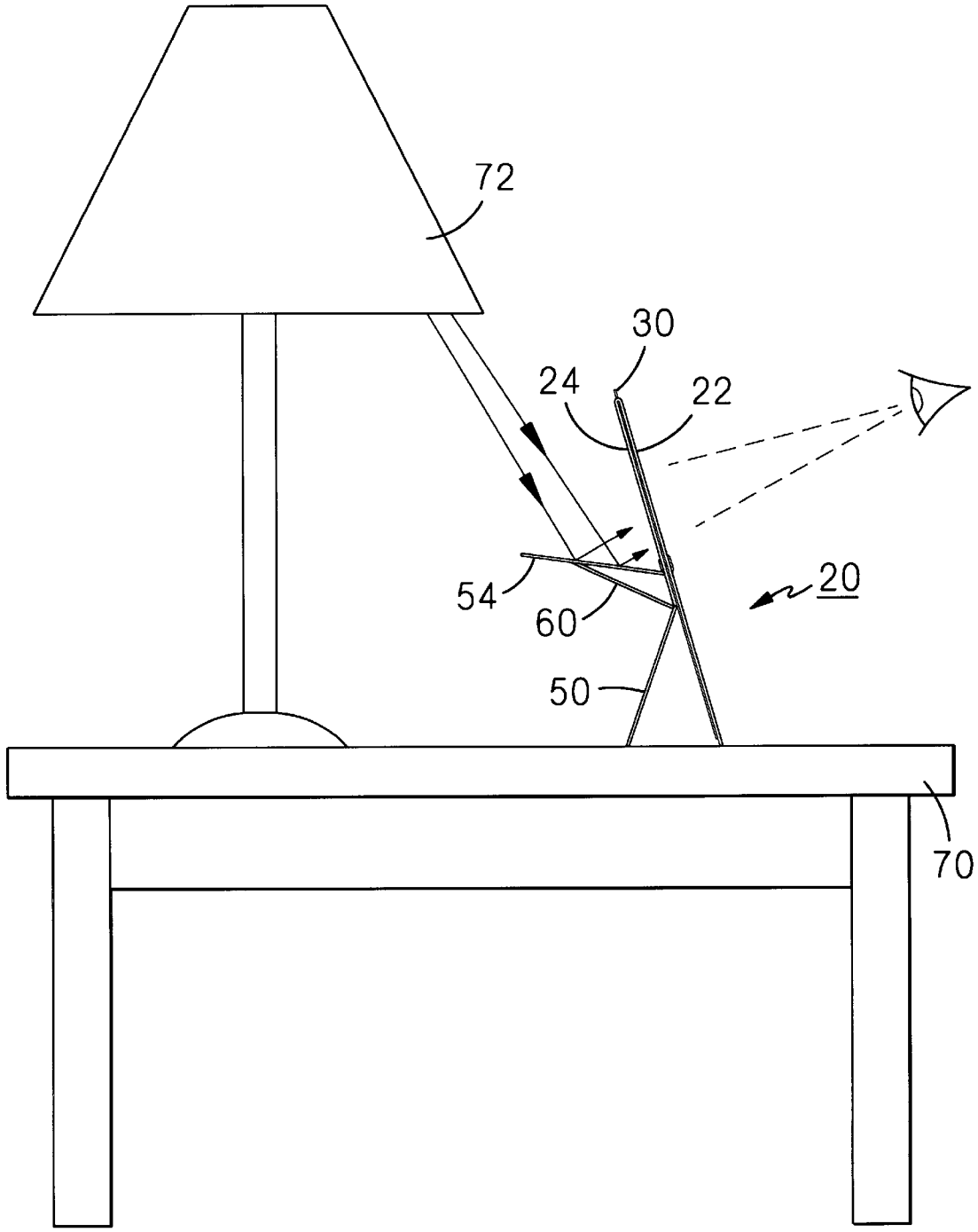
FIG. 8 is side elevational view showing the Chanukah card unfolded and in use.

FIG. 8 illustrates card 20 in use and the mechanism by which candles 46 are selectively "lighted". Here, card 20 has been unfolded and placed on a tabletop 70 in proximity to an incandescent lamp 72. Light from lamp 72 is reflected from the upper surface of reflective panel 54 toward index wheel 30. Depending on how many holes 66 (FIG. 6) are aligned with apertures 46, none or all eight candles 44 will appear to be "lighted". Any apertures 46 which are not aligned with holes 66, will merely show the front surface of index wheel 30, the color of which is chosen to be somewhat neutral. The color of the upper surface of reflective panel 54 is chosen to simulate a flame. It will be understood that index wheel 30 will be rotated each day so that the numeral visible at the top of the wheel, e.g., the numeral "8" on FIG. 1, corresponds to the day of the Chanukah festival. It will be understood that lamp 72 is not required as a source of light and, for example, card 20 may be simply placed in a suitable location near a window. The external light source may also be a fluorescent source. Each of the different light sources has its own spectrum and, hence, enables different shades of light to be observable from the front of card 20.

With card 20 and lamp 72 arranged as shown on FIG. 8, little light falls on the front surface of the card, while almost maximum light falls on reflective panel 54. This automatically achieves a high degree of contrast essentially independent of lamp size, while still illuminating front panel 22.

The upper surface of reflective panel 54 may be of uniform color and may be iridescent or it may be a combination of colors. In addition, a pattern of dots (or other shapes) can be used to simulate movement of the light as an observer moves, since the reflecting surface is a distance behind apertures 46 and parallax is introduced. Reflective granules may also be affixed to the upper surface of reflective panel 54.

Figure 9:
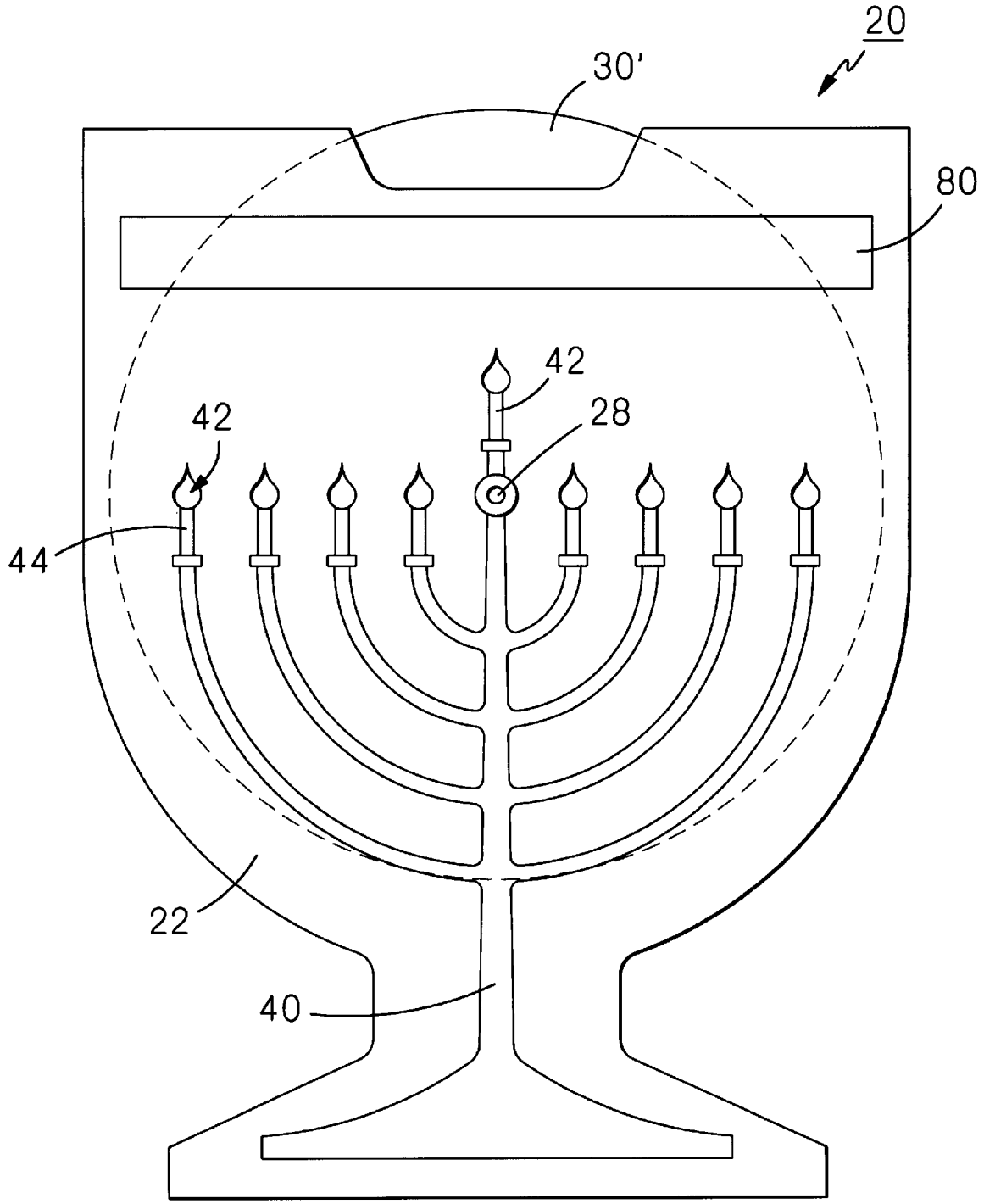
FIG. 9 is a front elevational view of another embodiment of a Chanukah card having a solar cell included thereon.

FIG. 9 illustrates an alternative embodiment of a somewhat more stylized Chanukah card, this one also indicated generally by the reference numeral 20, and having elements and functions similar to the embodiment described above, the principal difference being that index wheel 30' of this card is automatically indexed electrically. While a battery could be employed to provide the necessary power, this card includes a solar panel 80 disposed on front panel 22 to provide power. Solar cell 80 could also be disposed on any other suitable surface of card 20.

Figure 10:
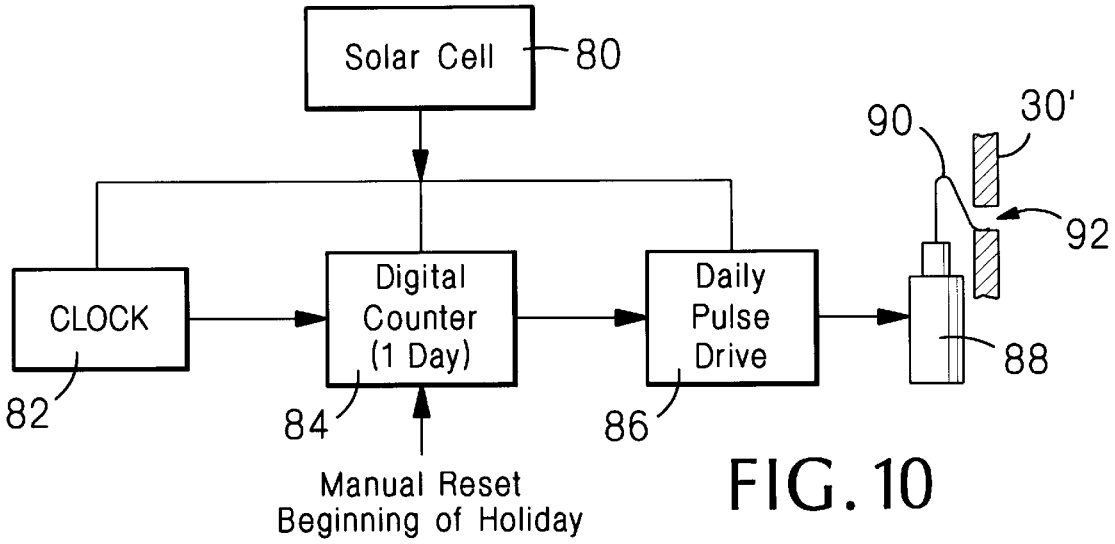
FIG. 10 is a schematic diagram of circuitry for use with the Chanukah card of FIG. 9 to automatically advance the index wheel thereof.

FIG. 10 illustrates the mechanism by which index wheel 30' is indexed. Solar cell 80, which includes suitable energy storage, is connected to provide power to a clock 82, a digital counter 84, a daily pulse drive 86, and a spring-return solenoid 88. Also included in the mechanism is a spring 90 connected to the core of solenoid 88 and having its distal end engaging an indexing hole 92 defined through index card 30'. Clock 82 is connected to provide pulses to digital counter 84 which is manually reset at the beginning of the holiday. When digital counter 84 counts one day, the counter provides a signal to daily pulse drive 86 which, in turn, energizes solenoid 88, causing spring 90 to move downwardly, thus rotating index wheel 30' the distance necessary to bring the next numeral (FIG. 7) to the top of the index wheel. Upon de-energization of solenoid 88, the distal end of spring 90 is released from indexing hole 92 and snaps into the next indexing hole (not shown) in a series of such holes. Each day, the procedure is automatically repeated.

Figure 11:
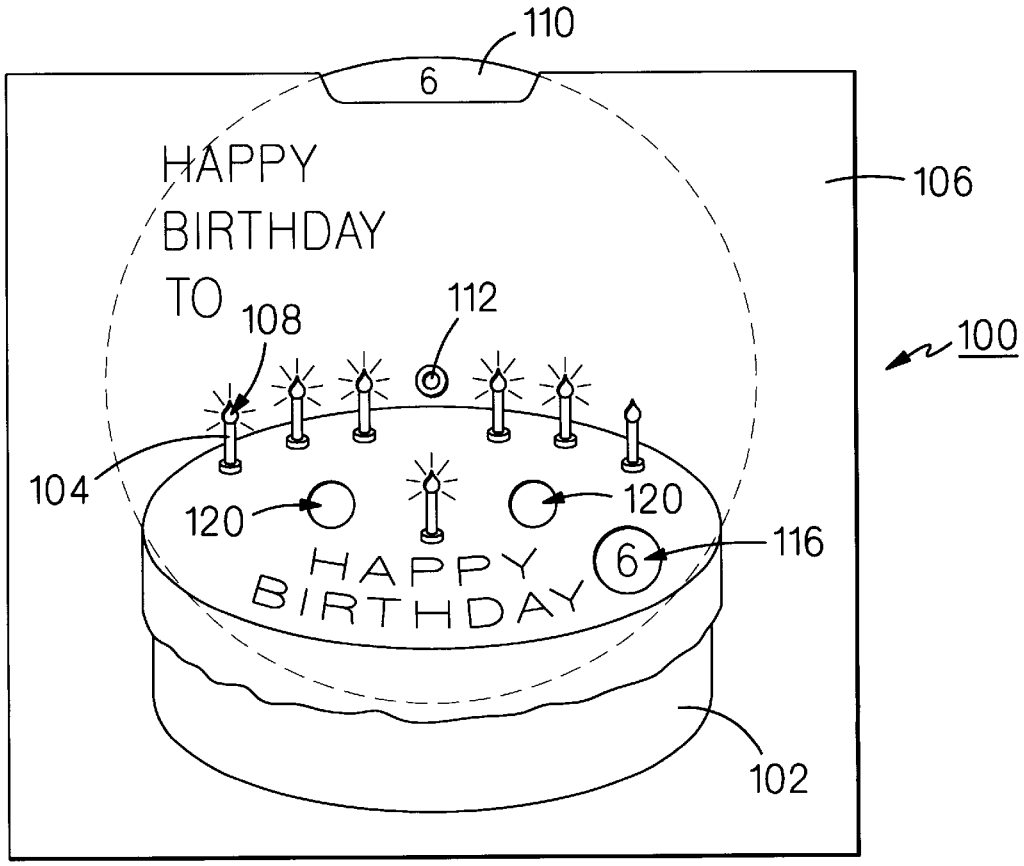
FIG. 11 is a front elevational view of a birthday card constructed according to the present invention.

FIG. 11 illustrates a birthday card constructed according to the present invention, and generally indicated by the reference numeral 100. Card 100, is similar to card 20 described above and includes a birthday cake 102 with a plurality of candles, as at 104, printed on a front panel 106. Front panel 106 includes a plurality of apertures, as at 108, defined therethrough. An index wheel 110 is rotatably mounted behind front panel 106 on a shaft 112. The above elements have the same functions as the similar elements of card 20 described above. FIG. 11 also illustrates that apertures 108 are not limited to being disposed in a line, but can be arranged arcuately. Also, the numeral representing the number of the birthday may be written in space 116. This embodiment includes two additional apertures 120 defined through front panel 106, the purpose of which is described below with reference to FIG. 12.

Figure 12:
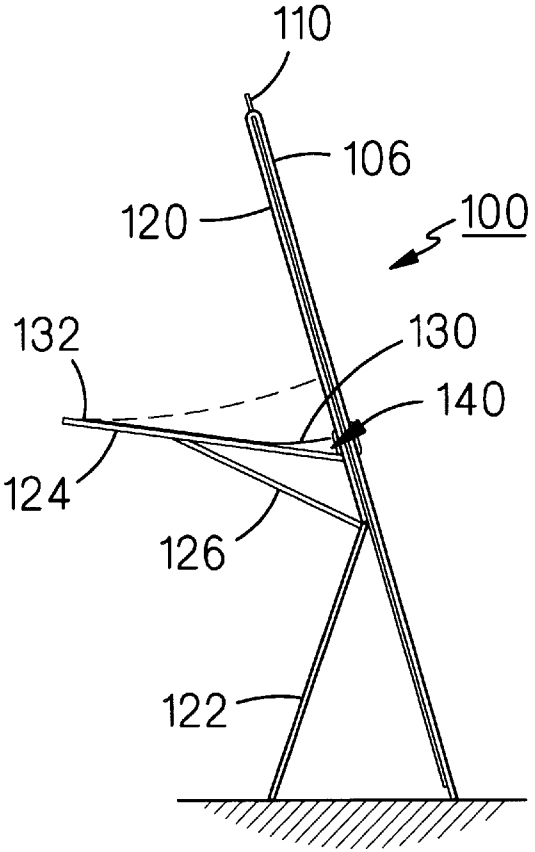

FIG. 12 shows a side view of card 100, the card including a rear panel 120, a support panel 122, a reflective panel 124, and a support tab 126, those elements having functions similar to like elements of card 20 above. Here, rather than the upper surface of reflective panel 124 itself being reflective, a thin reflective paper 130, having its distal end attached to the distal end of the reflective panel, is loosely placed on the upper surface of the reflective panel. The length of reflective paper 130 is such that its proximal end rests against the rear surface of rear panel 120, creating an open volume 140 between the lower surface of the reflective paper, the upper surface of reflective panel 124, and the rear surface of rear panel 120. In this position, light is reflected from the upper surface of reflective paper 130 through apertures 108 (FIG. 11).

Referring also to FIG. 11, apertures 120 are disposed such that they are aligned with open volume 140. Now, when a person blows through apertures 120 into open volume 140, reflective paper 130 is disengaged from the upper surface of reflective panel 124 and moves to the position shown by the broken line on FIG. 12. In this position, reflective paper 130 no longer reflects light through apertures 108 and it appears that candles 104 have been extinguished. Candles 104 can be "re-lighted" by manually returning reflective paper to the position shown by the solid line on FIG. 12.

Figure 13:
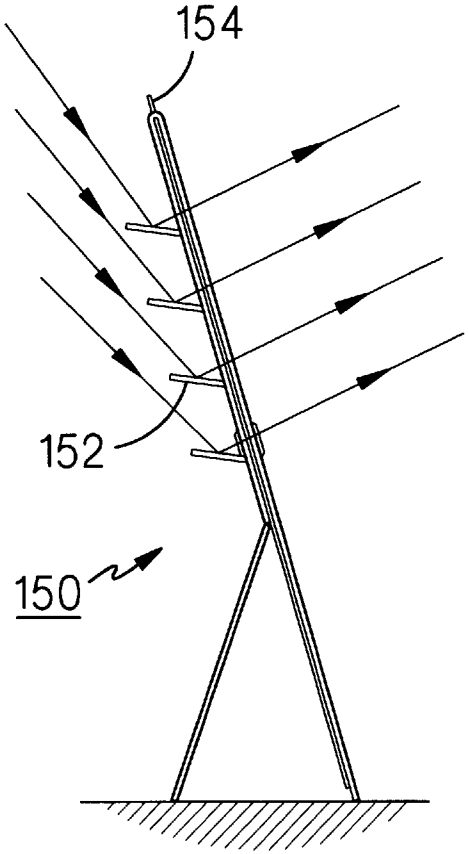

FIG. 13 illustrates another embodiment of the present invention, this one being a greeting card generally indicated by the reference numeral 150. Card 150 includes elements similar to those of card 20 described above, except that card 150 includes a plurality of reflective panels, as at 152, and an index wheel 154. Each of reflective panels 152 may have a color different from that of the other of the reflective panels so that apertures in the card will have a variety of colors. This arrangement can be used, for example, with a Christmas card having a Christmas tree printed on the front, so that the arrangement of lights on the Christmas tree may be varied. Index wheel 154 may be arranged so that certain lights are replaced with ornaments in certain positions of the wheel. Index wheel may be automatically periodically rotated, using a mechanism such as that of FIG. 10. In this embodiment, index wheel 154 may be omitted if it is desired only to have different colored lights without being able to vary the arrangement thereof. Reflective panels 152 are sufficiently short that no support tabs are required.

Figure 14:
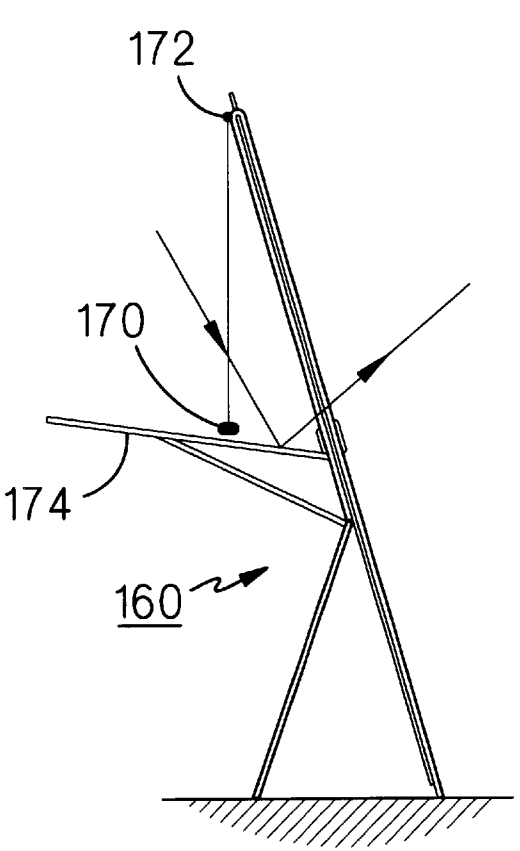
FIGS. 12–14 are side elevational views showing alternative embodiments of the present invention.

FIG. 14 illustrates yet another embodiment of the present invention, this one generally indicated by the reference numeral 160. Card 160 includes elements similar to those of card 20 described above, except that the ends of a bar pendulum 170 are attached at 172 near the top of card 160. Bar pendulum 170 oscillates in the path of light striking reflective panel 174 to simulate the flickering of light for a period of time by tapping the upper edge of the card to initiate movement of the pendulum. Alternatively, the bar may be provided of metal or have some metal included therein so that the pendulum may be kept moving with a minute amount of energy by being magnetically pulsed.

Lateral lighting is not common in houses or stores, but lighting having a vertical component, such as used in the present invention, is quite common. Were backlighting to be used for a similar display, it would be difficult to easily mask out the edges of the display.

A card of the present invention is safe and uses virtually no heat other than that caused by light falling on it. Any energy requirements are exceedingly low. There are no fumes produced and no oxygen consumption. Displays can be constructed according to the invention which are quite suitable for use in hazardous locations.

Many variations in construction are contemplated by the present invention and may be easily carried out by those skilled in the art by following the teachings presented above. For example, an index wheel without holes may be used, in which case reflective and non-reflective areas on the surface of the wheel would be used to simulate light or flame.

Coincidence of holes and apertures can be employed to highlight current menu or schedule items on those types of displays.

If a semi-transparent reflective material is disposed between the apertures in the front panel and the holes in the index wheel, the card could be used in either a transmitting or a reflecting mode.

A semi-transparent material having variable opacity may be disposed between the apertures in the front panel and the holes in the index wheel to vary the intensity of light passing therethrough.

The reflective surface may be provided with a textured surface.

Apertures of different sizes may be employed.

Color transparencies may be used for additional variation. For example, yellow and blue transparencies may be provided and, when they overlap in certain positions, the transmitted or reflected light will appear to be green.

Variations in sizes and shapes of holes and apertures in a given card may be used for different effects.

If holes and apertures are close to where a reflector flap is bent, various colors may be used on the flap.

Where automatic variation is desired, a wind-up mechanism may be employed, or, for large displays, the display may be wired to line power.

The apertures may be selectively formed by manually punching out pre-cut openings. If the display without an index wheel is to be reused another time, for example a Chanukah card, the apertures may be closed by folding flaps.

Figure 15:
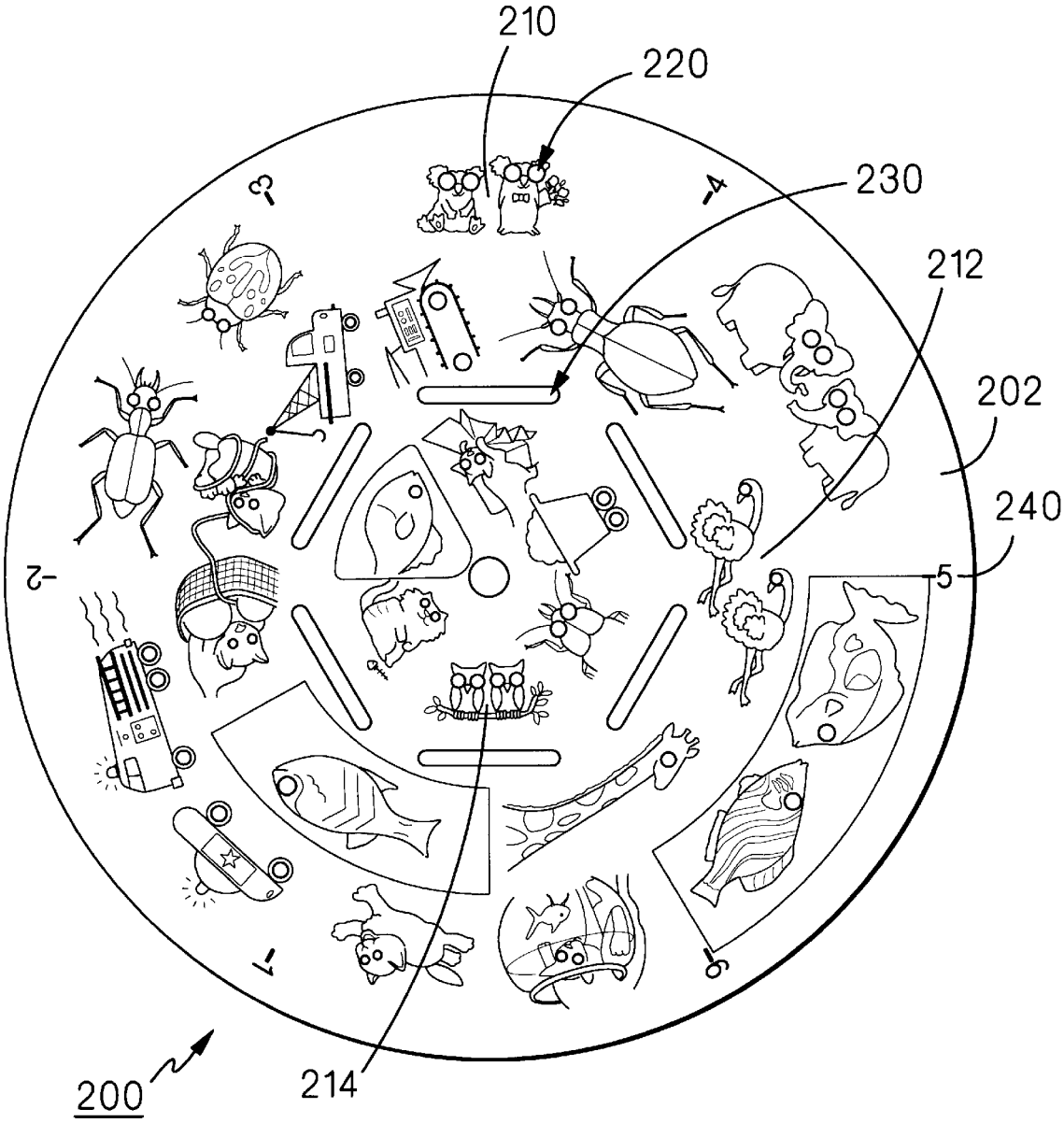
FIG. 15 is a front elevational view of an index wheel for an alternative embodiment of the present invention.
Figure 16:
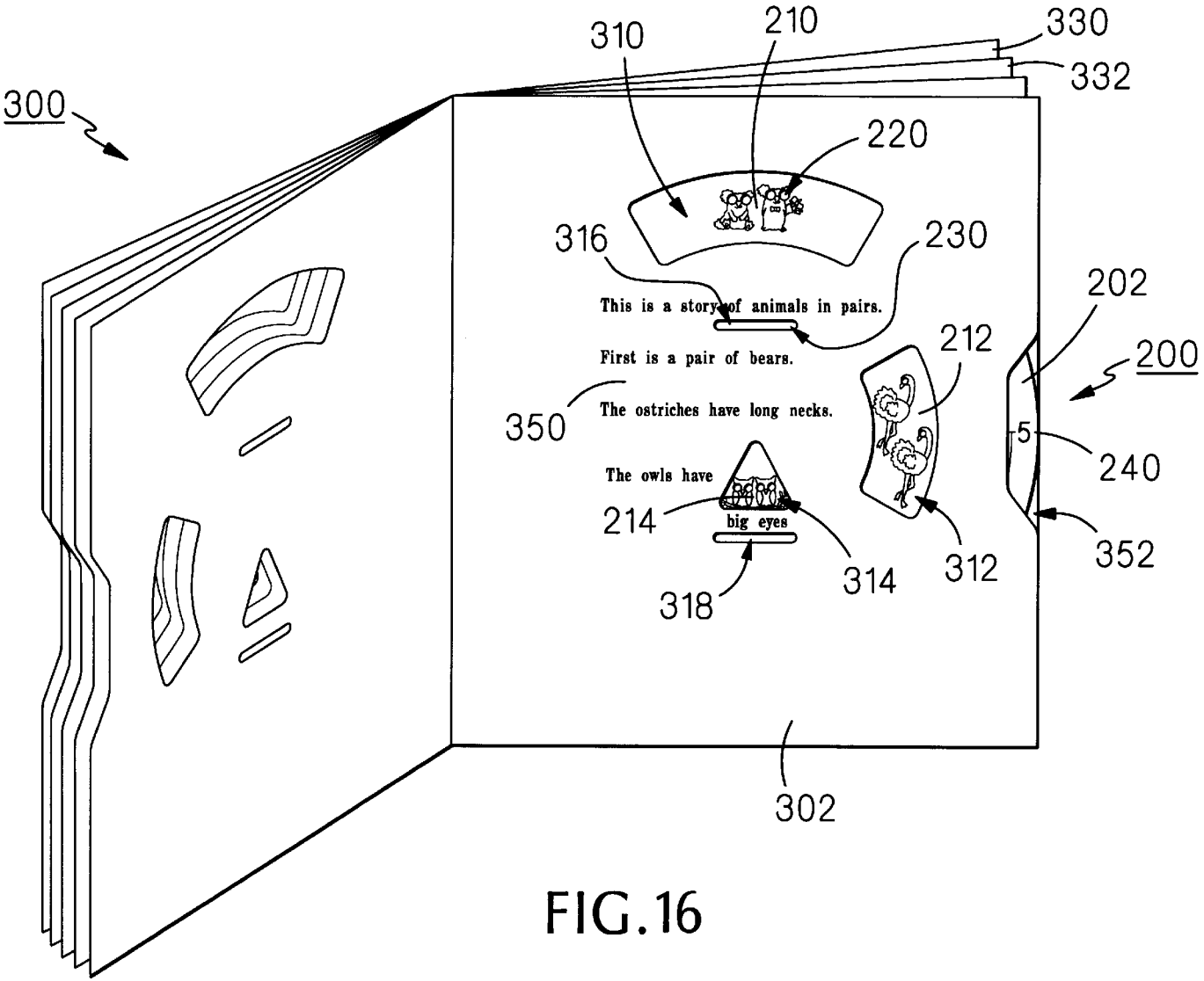
FIG. 16 is an isometric view of the index wheel of FIG. 15 employed in a book.

FIGS. 15 and 16 illustrate an embodiment of the present invention which incorporates several of the variations described above.

Referring first to FIG. 15, there is illustrated an alternative embodiment of an index wheel, constructed according to the present invention, and generally indicated by the reference numeral 200. Index wheel 200 includes a circular substrate 202 having transparencies (colored or not) of various figures mounted thereon, such that light from the rear of the index wheel can pass through the transparencies. For example, substrate 202 includes a pair of bears 210, a pair of ostriches 212, and a pair of owls 214. To accent selected portions of the figures, a portion of a transparency may be clear or cut out, such that that portion will appear brighter than the rest of the transparency. Such a portion, for example, is eye 220 of one of bear pair 210. Other selected areas of substrate 202 which are left clear or are cut out are elongated light transmitting areas, such as at 230, the purpose of which is described below.

Index wheel 200 is arranged so as to have six different positions, as indicated by the numerals around the periphery of the index wheel, for example at 240.

FIG. 16 illustrates index wheel 200 (FIG. 15) used as part of a book, the book being generally indicated by the reference numeral 300. Book 300 includes a plurality of pages, such as page 302, having defined therethrough, at least in the case of page 302, openings 310, 312, 314, 316, and 318. It will be understood that a later page in book 300, preferable the last page, page 330, or the back of the book, will include one or more reflective flaps (not shown), as described previously, and that the second to the last page, page 332, will include index wheel 202 rotatably mounted thereon, also previously described.

So arranged, it will be understood that pages following page 302 will have defined therethrough at least openings aligned with openings 310, 312, 314, 316, and 318 so that the transparencies on index wheel 200 aligned with those openings will be visible when viewing that page when illuminated by light reflected from the reflective flaps on last page 330. Pages preceding page 302 may not have openings corresponding to all the openings associated with page 302.

Page 302 includes text 350 thereon. A portion of index wheel 200 (FIG. 15) is accessible through a cutout 352 defined through the edge of page 302 and the index wheel has been rotated so that the index wheel is in position "5". In this position, for example, bear pair 210 is visible through opening 310. It will be understood that similar cutouts will be provided in any subsequent pages, aligned with cutout 352, up to the page in which index wheel 200 is disposed so that the edge of the index wheel may be grasped to rotate the index wheel. Light transmitting area 230 in index wheel 200 is visible through opening 316 and highlights the word "animal" in text 350, while a similar light transmitting area in the index wheel highlights "big eyes" in the text.

After page 302 is turned, exposing the next succeeding page (the sixth page of book 300), index wheel 200 will be rotated to position "6" so that a new set of figures corresponding to the text on that page is visible through openings defined through that page.

As with the embodiments described above, figures on index wheel 200 may include those formed from plastic, paper, cut-outs, transparencies, drawings, photographs mounted on thin paper or a translucent surface, combinations of the foregoing, and like materials. Page 302 may be formed as a "pop-up" containing text and/or pictorial matter. A book containing such "pop-ups" will have an index wheel and a reflective flap behind each page used as a "pop-up".

Figure 17:
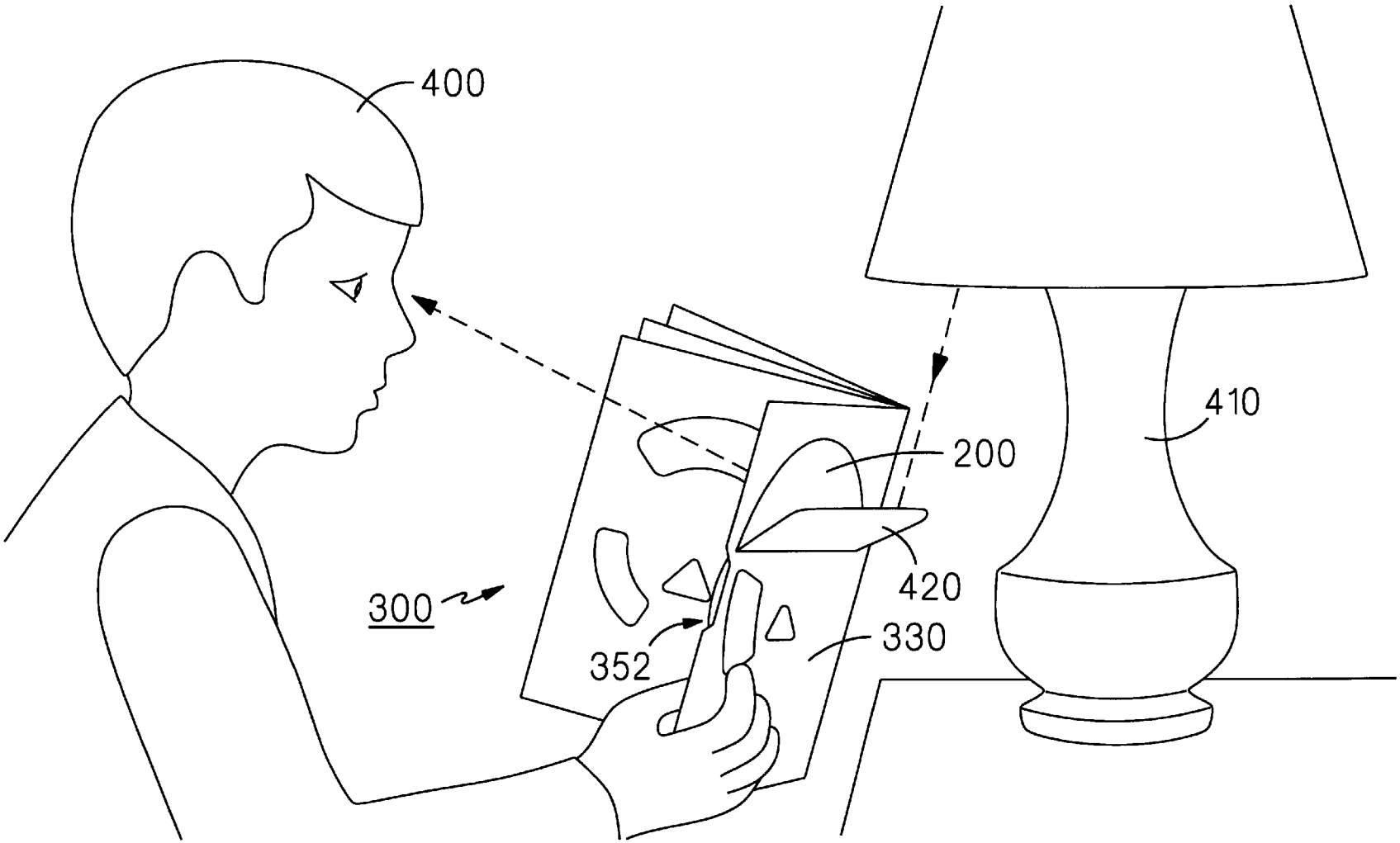
FIG. 17 is a side elevational view of a person viewing the book of FIG. 16.

FIG. 17 illustrates a person 400 viewing a page of book 300, with light from a lamp 410 being reflected by reflector flap 420 through index wheel 200 to the person's eyes.

In order that book 300 may convey more information, a second index wheel (not shown) may be provided near the front of the book, in similar fashion to index wheel 200 provided near the rear of the book. In this case, a person viewing the book would view portions of the second index wheel through the back side of each page of book 300 in addition to viewing portions of index wheel 200 through the front side of each page of the book.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A display device, comprising:

(a) at least one panel having defined therethrough at least two apertures;

(b) an index panel disposed behind said at least one panel and moveable between at least first and second positions to vary what can be viewed through said at least two apertures by an observer looking at said at least one panel;

(c) said index panel has defined therethrough at least two light transmission paths selectively alignable with said at least two apertures; and (d) light transmitting means disposed behind said index panel to pass light through at least some of said at least two apertures when said at least some of said at least two apertures are aligned with at least some of said at least two light transmission paths.

2. A display device, as defined in claim 1, wherein: said index panel has thereon reflective areas selectively alignable with said at least two apertures to reflect light passing through at least some of said at least two apertures.

3. A display device, as defined in claim 1, wherein: said light transmitting means comprises reflective means disposed behind said index panel so as to receive light from a light source and reflect said light through said at least two light transmission paths.

4. A display device, as defined in claim 3, wherein: said apertures are in positions of candle flames on a pictorial representation on said at least one panel, such that aligned ones of said at least some of said apertures and said at least some of said at least two light transmission paths appear to said observer to be candle flames.

5. A display device, as defined in claim 4, wherein:

(a) said at least two apertures are eight in number;

(b) said pictorial representation is a menorah;

(c) said at least two light transmission paths in said index panel are arranged such that said index panel may be selectively moved to one of eight positions, to selectively align one to eight of said eight apertures with one to eight of said at least two light transmission paths; and (d) another aperture is aligned with one of said at least two light transmission paths and appears to said observer to be a lighted shamash whenever said one to eight of said eight apertures is selectively aligned with said at least two light transmission paths.

6. A display device, as defined in claim 5, wherein said display device is a Chanukah greeting card and wherein:

(a) a rear panel is attached to said at least one panel;

(b) said index panel is rotatably disposed between said rear panel and said at least one panel;

(c) said reflective means includes a panel formed as part of said rear panel and attached to and foldable away from said rear panel; and (d) said rear panel includes a support panel formed as part of said rear panel and attached to and foldable away from said rear panel such that lower edges of said rear panel and said front panel may be used to stably support said Chanukah greeting card on a horizontal surface.

7. A display device, as defined in claim 6, wherein: when said reflective means and said support panel are folded into said rear panel, said Chanukah greeting card is nearly flat.

8. A display device, as defined in claim 6, further comprising: numerals from "1" to "8" disposed on said index panel, one of said numerals being visible to said observer and equal to the number of said aligned ones of said at least some of said apertures and said at least some of said at least two light transmission paths.

9. A display device, as defined in claim 4, wherein said display device is a birthday card and wherein:

(a) said pictorial representation is a birthday cake;

(b) a rear panel is attached to said at least one front panel;

(c) said reflective means includes a panel formed as part of said rear panel and attached to and foldable away from said rear panel;

(d) a flexible reflective flap is disposed on said panel in a reflective position to reflect said light to said at least two light transmission paths;

(d) an open volume is defined between said flap, said panel, and said rear panel; and (e) aligned passages are defined through said at least one panel and said index panel into said open volume, such that air blown through said aligned passages will cause said reflective flap to move from said reflective position to a non-reflective position so that said light is no longer reflected to said at least two light transmission paths.

10. A display device, as defined in claim 3, further comprising:

(a) a rear panel attached to said at least one panel, with said index panel disposed between said rear panel and said at least one panel; and (b) said reflective means includes at least two panels attached to said rear panel and disposed such that said at least two reflective panels reflect light to different groups of said at least two light transmission paths.

11. A display device, as defined in claim 1, wherein: said index panel is automatically moved between said at least first and second positions as a function of time.

12. A display device, as defined in claim 3, wherein:

(a) said reflective means comprises a flexible reflective flap; and (b) pendulum means is attached to said flexible reflective flap, such that, when said pendulum means is moving, light passing through said at least two apertures will appear to flicker.

13. A display device, as defined in claim 1, wherein: at least some of said at least two light transmission paths are semitransparent areas of said index panel.

14. A display device, as defined in claim 13, wherein: said semitransparent areas comprise one or more materials selected from the group consisting of: plastic, paper, cutouts, transparencies, drawings, photographs mounted on thin paper or a translucent surface, combinations of the foregoing, and like materials.

15. A display device, as defined in claim 1, wherein: at least some of said at least two light transmission paths are holes defined through said index panel.

16. A display device, as defined in claim 1, wherein: said display device comprises a greeting card.

17. A display device, as defined in claim 1, wherein: said display device is a book and said at least one panel is a page of said book.

18. A display device, as defined in claim 1, wherein: said display device is a book and said index panel is disposed at an end of said book.

19. A display device, as defined in claim 1, wherein: said display device is a book and said index panel is disposed at a front of said book.

20. A book, comprising:

(a) at least two pages, a first one of said at least two pages having defined therethrough at least a first aperture aligned with a corresponding at least a second aperture defined through a second one of said at least two pages;

(b) an index panel disposed behind said at least two pages and moveable between at least first and second positions to vary the display portion viewed through said apertures by an observer looking at said at least two pages; and (c) said index panel being moved to said first position when said first one of said at least two pages is viewed and said index panel being moved to said second position when said second one of said at least two pages is viewed.

21. A book, as defined in claim 20, wherein: said index wheel has a reflective surface to reflect light which passes through said at least a first aperture and said at least a second aperture to said index panel.

* * * * *